US005410283A

United States Patent [19]

Gooray et al.

[11] Patent Number: 5,410,283

[45] Date of Patent: Apr. 25, 1995

[54] PHASE SHIFTER FOR FINE TUNING A MICROWAVE APPLICATOR

[75] Inventors: Arthur M. Gooray; Kenneth C. Peter, both of Penfield, N.Y.

[73] Assignee: Xerox Corporation, Stamford, Conn.

[21] Appl. No.: 160,002

[22] Filed: Nov. 30, 1993

[51] Int. Cl.[6] ..... H01P 1/18

[52] U.S. Cl. ..... 333/159; 333/248

[58] Field of Search ..... 333/156, 157, 159, 21 A, 333/248, 81 B

[56] References Cited

U.S. PATENT DOCUMENTS

| | | | |
|---|---|---|---|
| 2,630,492 | 3/1953 | Muchmore | 333/159 |
| 2,774,946 | 12/1956 | McGillem et al. | 333/157 |
| 3,584,389 | 6/1971 | Hilton et al. | 34/1 |
| 3,617,953 | 11/1971 | Kingma et al. | 333/17 |
| 3,672,066 | 6/1972 | Stephansen | 34/1 |
| 3,739,130 | 6/1973 | White | 219/10.55 |
| 4,234,775 | 11/1980 | Wolfberg et al. | 219/10.55 |
| 4,286,135 | 8/1981 | Green et al. | 219/10.55 |
| 4,332,091 | 6/1982 | Bensussan et al. | 34/1 |
| 4,469,026 | 9/1984 | Irwin | 101/426 |
| 4,613,836 | 9/1986 | Evans | 333/157 X |
| 5,079,507 | 1/1992 | Ishida et al. | 324/645 |

FOREIGN PATENT DOCUMENTS

| | | | |
|---|---|---|---|
| 0630797 | 11/1961 | Canada | 333/159 |
| 1003212 | 3/1983 | U.S.S.R. | 333/81 B |

*Primary Examiner*—Seungsook Ham

*Attorney, Agent, or Firm*—Daniel J. Krieger

[57] ABSTRACT

A phase shifter for shifting the phase angle of microwaves traveling in a waveguide of a microwave circuit. The phase shifter includes a dielectric plate which has first and second parallel surfaces, a distal edge, a proximate edge, a leading edge, and a trailing edge where each of the edges defines the outer bounds of the first and second parallel surfaces. The dielectric plate is shaped like a parallelogram lacking any right angles and is made of a microwave low loss dielectric material such as polystyrene or polytetrafluoroethylene. The height of the dielectric plate is less than one half the height of the waveguide side wall and the length is less than one guide wavelength long. The phase shifter fine tunes a resonating microwave circuit and provides approximately three-quarters of an inch adjustment of microwave circuit length.

17 Claims, 9 Drawing Sheets

PHASE SHIFTER FOR FINE TUNING A MICROWAVE APPLICATOR

CROSS-REFERENCE TO RELATED APPLICATION

Cross-reference is made to patent application Attorney Docket No. D/92371 entitled "Dummy Load for Microwave Dryer" and patent application Attorney Docket No. D/93143 entitled "Apparatus and Method for Drying Ink Deposited by Ink Jet Printing" being filed concurrently herewith.

FIELD OF THE INVENTION

The present invention relates generally to drying ink deposited by an ink jet printer and more particularly relates to a phase shifter for fine tuning a microwave applicator.

BACKGROUND OF THE INVENTION

Many inks and particularly those used in thermal ink jet printing include a colorant and a liquid which is typically an aqueous liquid vehicle. Some thermal ink jet inks also include a low vapor pressure solvent. When a substrate or a sheet of paper is printed with ink jet ink, the ink is deposited on the substrate to form an image in the form of text and/or graphics. Once deposited, the liquid is removed from the ink and paper to fix the ink to the substrate. The amount of liquid to be removed, of course, varies with the amount of ink deposited on the substrate. If a sheet is covered with 10% printing, as in text only printing, the amount of liquid to be removed is quite small. If the sheet is, covered with 90% printing, however, as when a graphic image is printed, the amount of liquid to be removed is substantially more and can cause image defects and paper deformation if not removed very rapidly.

Liquid can be removed from the ink and printed substrate by a number of methods. One simple method is natural air drying in which the liquid component of the ink deposited on the substrate is allowed to evaporate without mechanical assistance resulting in natural drying. Another method is to send the printed substrate through a dryer to evaporate the liquid. In some cases a special paper is used in which the liquid is absorbed by a thin coating of natural material deposited on the surface of the paper. Blotting of the printed substrate is also known.

In the case of natural drying, almost 100 percent of the liquid is absorbed into the paper and is then, over a long period of time, evaporated naturally. The absorption and desorption of water into and out of the paper, however, has some undesirable side effects, such as long drying time, strike through, feathering at edges of the printed image, paper curl and paper cockle. In the case of paper cockle, the absorption and desorption of the water relaxes the internal stresses of the paper and results in deformations known as cockle. Cockle is also a function of the amount of liquid deposited per unit area. Less printing on a page has less potential to develop cockle due to the smaller amount of liquid. More printing on a page has more cockle potential due to a higher amount of liquid per unit area. Cockle can also be induced by heating of the paper, which results in stress relief.

Ink compositions also have an effect on the drying rates and drying efficiency. For example, highly absorptive (fast drying) inks while requiring less ink to be removed by a dryer are prone to image quality defects such as feathering, raggedness, and strike through. On the other hand, slightly absorptive inks require more power from a dryer to dry since more ink requires evaporation.

The rate at which the image is dried is also critical for controlling the print quality. A slow drying rate can achieve ink permanence or drying effectiveness but also can result in image quality defects such as excessive image feathering or strike through. Additionally, a slow drying rate can result in image offset (ink from one sheet of paper is transferred to another sheet of paper because the ink has not dried completely), smear and spreading from contact with exit rolls, baffles and output stacking of the individual sheets. A very fast drying rate can result in image mottle and image spatter.

Drying rates are particularly critical when substrates are printed at high rates of speeds. Not only must image deformations and paper deformations be controlled, but the drying times must be short due to the high printing rates to ensure no offset at exit rolls.

A dryer must achieve image fixing (no offset/smear) and good image quality to reduce or prevent image disturbance, distortion, feathering and strike through. In addition the dryer must preferably reduce or eliminate cockle and curl. Besides the slow speed of conventional dryers, many dryers produce uneven drying rates resulting in uneven drying patterns. To shorten drying times, infrared drying techniques have been adopted. This method can, however, cause browning of paper during paper jams due to the elevated temperatures produced by the infrared heat.

Microwave dryers have been used for drying ink deposited on paper with varying degrees of success. Microwave dryers of various types are described in, for example, U.S. Pat. Nos. 3,584,389, 3,672,066, 3,739,130, 4,234,775 and 4,469,026. The efficient application of microwave power with a microwave dryer requires a properly tuned microwave circuit. Phase shifters are one way of tuning microwave circuits.

U.S. Pat. No. 3,617,953 to Kingma et al. describes a microwave impedance matching system for matching a microwave input waveguide to a microwave output waveguide. A first and second electromechanical phase shifter are moved transversely in waveguide sections to produce varying amount of differential phase shift.

U.S. Pat. No. 4,234,775 to Wolfberg et al. discloses a device which has a serpentine waveguide and uses microwave energy to remove moisture from a moving web. The microwave energy takes the form of standing waves which are purposefully disrupted to cause the peaks of the standing waves to continuously oscillate along the various sections of the waveguide, resulting in a more uniform application of the microwave energy across the width the web.

U.S. Pat. No. 4,286,135 to Green et al. describes a waveguide isolator having microwave ferrite bars to reduce energy reflected into the microwave source. A blower fan draws air past the microwave source and through a waveguide to provide cooling.

U.S. Pat. No. 4,332,091 to Bensussan et al. describes a microwave drying device intended for drying grains having a phase shifter allowing the phase to be adjusted to obtain maximum efficiency of the device.

U.S. Pat. No. 5,079,507 to Ishida et al. describes an automatic impedance adjusting apparatus for adjusting an impedance seen looking toward a microwave load. A cooling air outlet exhausts cooling air into a circular waveguide.

SUMMARY OF THE INVENTION

In accordance with the present invention, there is provided a phase shifter for shifting the phase angle of microwaves traveling in a waveguide having a top wall, a bottom wall, and side walls. The phase shifter includes a dielectric plate having first and second substantially parallel surfaces, a distal edge, a proximate edge, a leading edge, and a trailing edge. Each of the edges defines the outer bounds of said first and second parallel surfaces. The proximate edge is located next to the interior surface of either the bottom or top wall. The dielectric plate has a height of less than one-half the height of the: side wall and a length of less one one guide wavelength long.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention. Consequently, many modifications and variations are possible in light of the teachings herein by those skilled in the art as expressed in the specification and the appended claims.

DETAILED DESCRIPTION OF THE INVENTION

Figure 1:
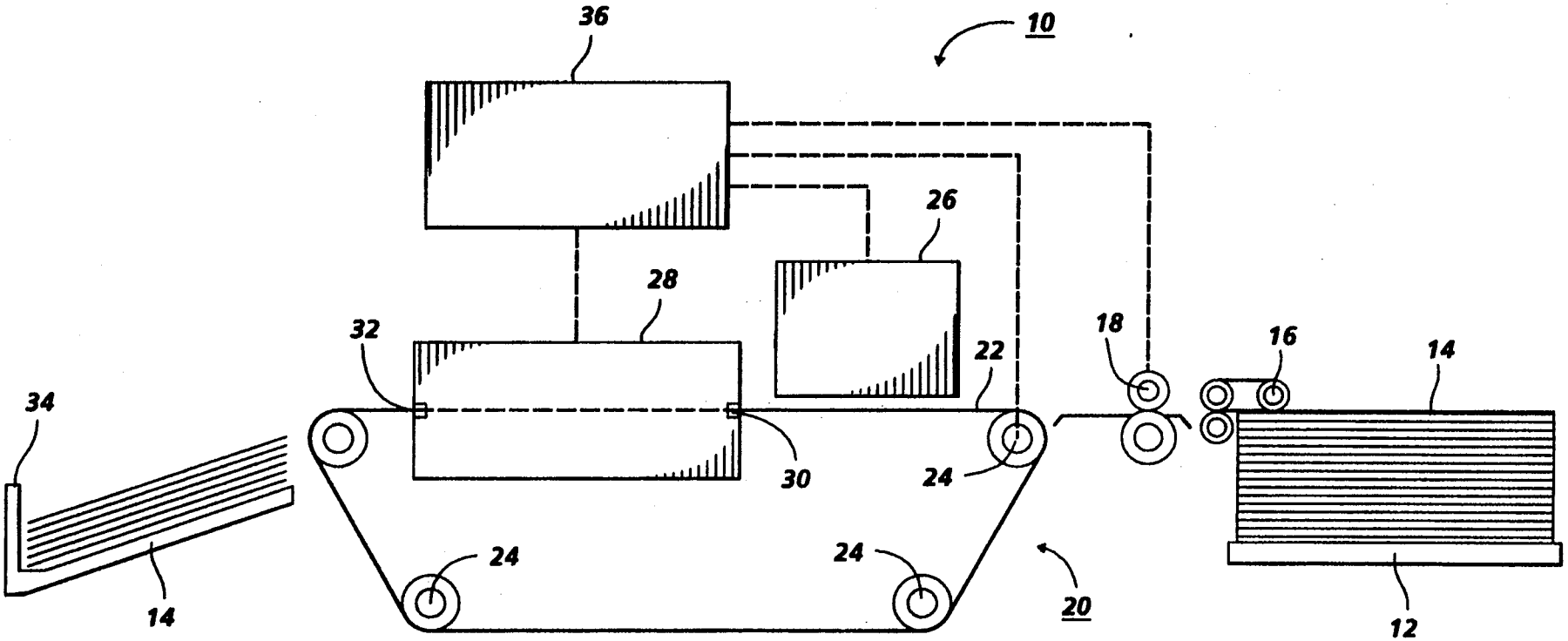
FIG. 1 is a schematic elevational view of an ink jet printer suitable for use with the present invention.

FIG. 1 illustrates a schematic view of an ink jet printer 10 of the present invention. The ink jet printer 10 includes an input tray 12 containing cut sheets 14 of paper stock to be printed upon by the ink jet printer 10. Single sheets 14 of paper are removed from the input tray 12 by a pick-up roller 16 and fed by feed rollers 18 to a paper transport mechanism 20. The paper transport mechanism 20 moves the sheet 14 by a feed belt or belts 22 driven by rollers 24 beneath a printing member 26. The belts 22 are made of a material transparent to microwave power having a low dielectric constant. The printing member 26 includes a pagewidth ink jet printhead which deposits ink on the sheet 14 as the sheet moves past the printhead. The pagewidth ink jet printhead is a linear array of print nozzles as wide as the sheet so that ink is deposited across the entire width of a sheet. The present invention is equally applicable, however, to printers having an ink jet printhead which moves across the sheet 14 periodically, in swaths, to form the image, much like a typewriter. The print member 26 includes an ink supply and the necessary electronics to control the deposition of ink on the page.

Preferably, ink specially formulated to be heated by microwave power is used. Such ink may include compounds designed to couple with the microwave power for increasing the amount of heat conducted thereby. One such compound is an ionic compound at least partially ionizable in the liquid vehicle. U.S. Pat. No. 5,220,346, entitled "Printing Processes with Microwave Drying", assigned to Xerox Corporation, discloses a suitable ink and is hereby incorporated in this application by reference.

Once the sheet 14 has printed, the sheet 14 is carried by the paper transport, immediately after printing or within about 5 seconds or less, to a microwave dryer 28. The sheet enters an input slot 30 and exits an output slot 32. A transport mechanism, such as one using a vacuum applied to the bottom side of the paper or one using a static mat carries the paper through the microwave dryer 28. As the sheet 14 passes through the microwave dryer 28, microwave power is delivered to the sheet 14 to thereby dry the ink deposited thereon. Once the sheet 14 is substantially dry, the sheet is sent to an output tray 34.

A controller 36 controls the printing member 26, the microwave dryer 28, and the paper transport mechanism 20 as would be understood by one skilled in the art. In addition, an adaptive dryer control for ink jet processors can also be used. U.S. Pat. No. 5,214,442, entitled "Adaptive Dryer For Ink Jet Processors", assigned to Xerox Corporation, discloses such an adaptive dryer control and is hereby incorporated in this application by reference.

Microwave dryer 28 has such a fast drying rate that the excess liquid in the ink on the substrate is evaporated from the surface of the printed sheet before any appreciable absorption occurs. Additionally, microwave power generated in the dryer 28 produces an electric field sufficiently large to effectively dry a thin layer of ink on the paper substrate.

To control image quality defects in the ink jet printer 10, ink is deposited on the substrate from printhead 26, and the printed substrate is passed to dryer 28 for rapid drying. Preferably, the substrate travels through dryer 28 at a speed ranging from about 2 inches to 20 inches per second, or from about 10 prints to 200 prints per minute. In the printer 10 described above, input slot 30 is located approximately three inches from printhead 26. With the paper speed of 2 to 20 inches per second, the total time from depositing the ink on the substrate to enter the dryer is approximately 1.5 seconds to 0.15 seconds. Thus, using a serpentine dryer, for example, with a total drying zone of 6.75 inches, the substrate exits the dryer in 5 to 0.5 seconds.

Figure 2:
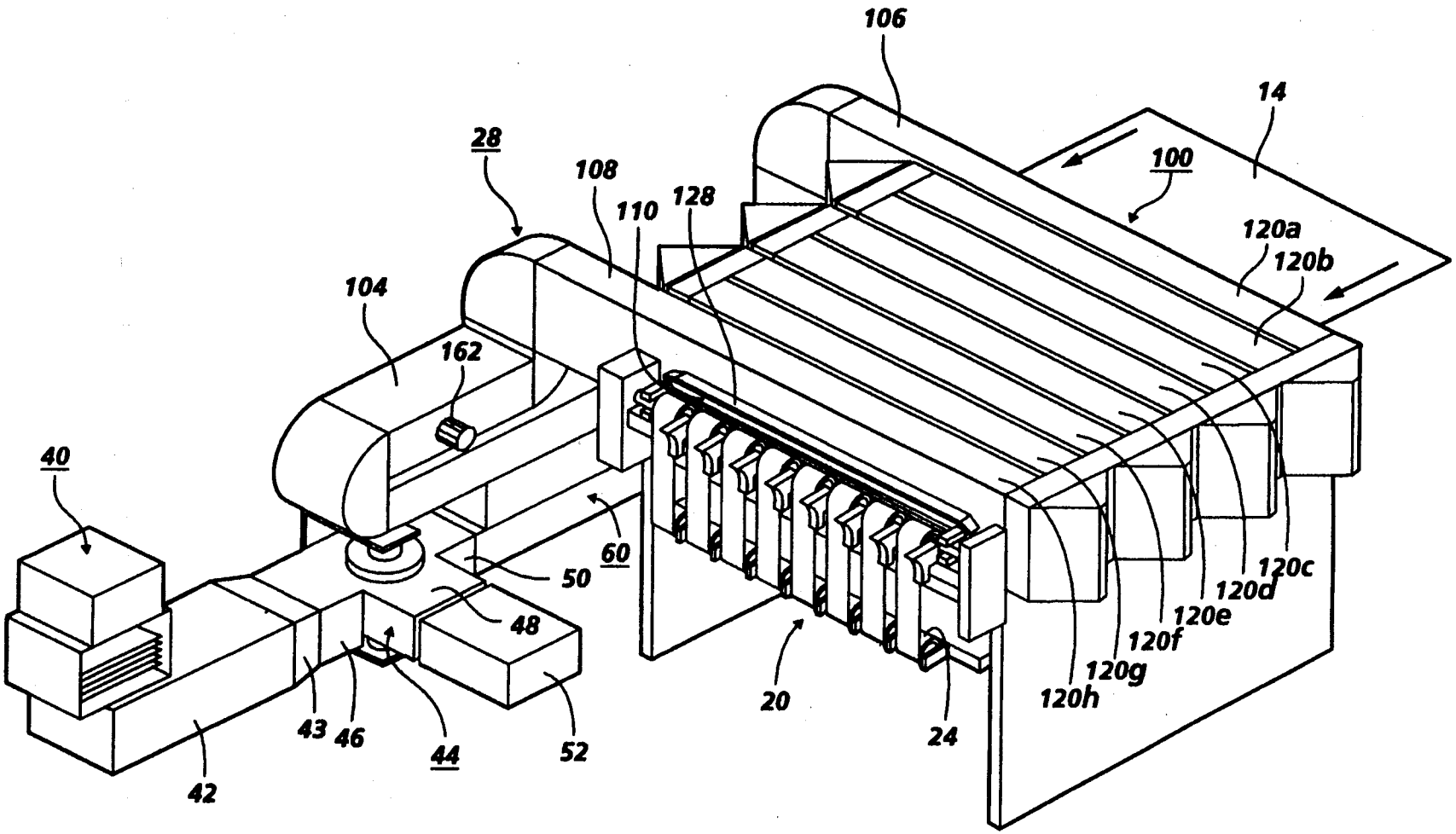
FIG. 2 is a perspective view of a microwave dryer in accordance with the present invention.

FIG. 2 illustrates one embodiment of the microwave dryer 28. The microwave dryer 28 comprises a traveling wave resonator which enhances the field intensity to which the paper is exposed. By using a traveling wave resonator, the electric field intensity sufficient to dry ink effectively is possible with a relatively low power (less than 1.5 KW) magnetron. In addition, because traveling waves are used, uniformity of heating is much better than if standing waves are used and the applicator is not greatly affected by differences in the load or the paper and the amount of ink coverage.

The paper transport mechanism 20 moves paper through the microwave dryer 28 by a belt or plurality of belts carried by the rollers 24. The microwave dryer 28 includes a microwave generator 40 for generating microwaves. The microwave generator 40 includes a 2455 MHz fixed frequency magnetron and a magnetron power supply as is understood by one skilled in the art. Such magnetrons are commonly used in household microwave oven applications and are available from several Japanese manufacturers at low cost. A magnetron generator with a power in the range of approximately 500–1500 watts is preferably used to generate the microwaves.

As seen in FIG. 2, the microwave generator 40 is connected to a waveguide launcher 42. The waveguide launcher 42 is a mount for the magnetron that allows the magnetron to radiate efficiently into a waveguide. The waveguide launcher 42 includes a transition section 43. The transition section 43 connects the output of the launcher 42 to a circulator 44 having a first port 46, a second port 48 and a third port or main waveguide feed 50. The second port 48 is coupled to a matched load 52.

The circulator 44 is used to ensure stable operation of the magnetron under the operating conditions. The circulator is a non-reciprocal ferrite device that allows power to flow from the microwave generator 40 to a microwave applicator. The matched load 52 absorbs reflected power to protect the magnetron 40 from damage. The matched load 52 includes a tuning screw to permit fine tuning of the circuit to have a termination Voltage Standing Wave Ratio (VSWR) of less than 1.02.

Figure 3:
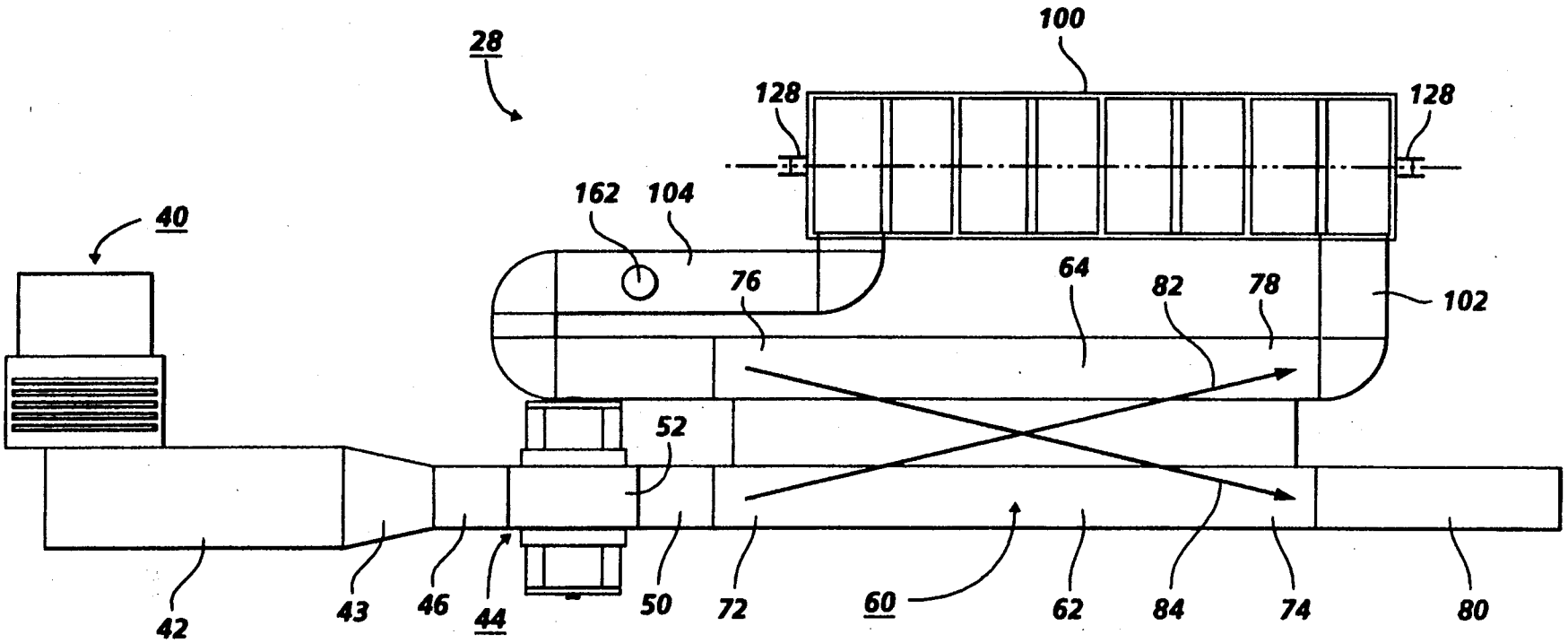
FIG. 3 is an elevational view of the FIG. 2 microwave dryer.
Figure 4:
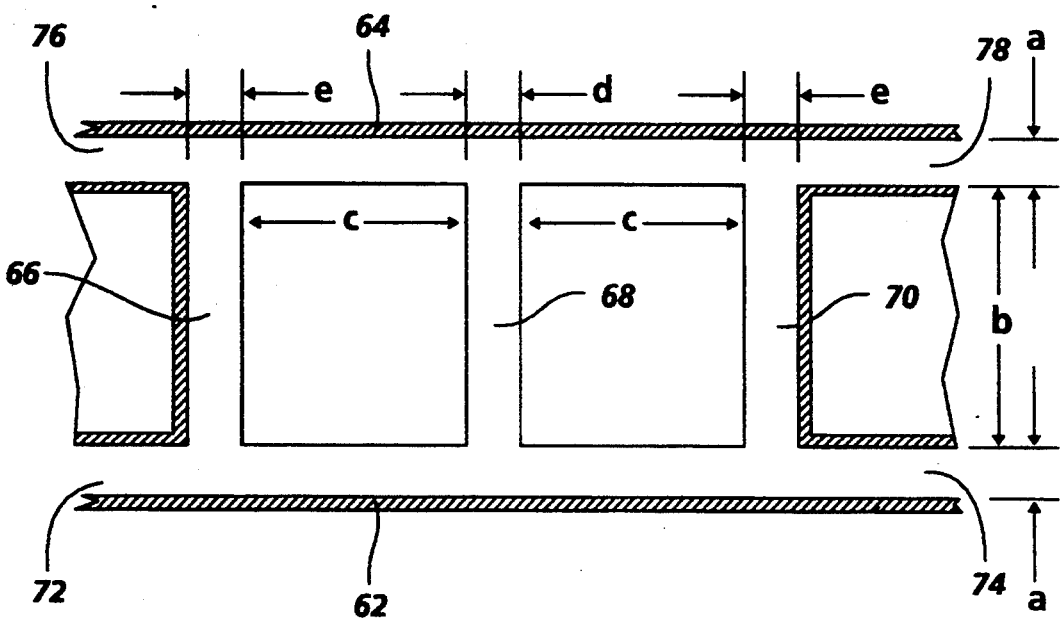
FIG. 4 is a sectional plan view of a three-branch coupler.

A branch guide directional coupler 60 is connected to the main waveguide feed 50 as shown in FIG. 3. The directional coupler 60 comprises a main waveguide 62 and an auxiliary waveguide 64 more clearly seen in FIG. 4. The main and auxiliary waveguides are connected together by a first, a second and a third branch waveguide 66, 68, and 70 respectively. Each of the branch guides is nominally a quarter of a guide wavelength long.

The main waveguide 62 has a first arm 72 and a second arm 74. The auxiliary waveguide 64 has a third arm 76 and a fourth arm 78. When power flows in the main waveguide 62 from the first arm 72, some power will be coupled to the auxiliary waveguide through the branch waveguides 66, 68 and 70 and some power flows out the fourth arm 78. When power flows in the auxiliary waveguide 64 from third arm 76 to the fourth arm 78, some of the power is coupled to the main waveguide and flows out the second arm 74. The extent to which power is coupled between the main and auxiliary waveguides, i.e. the coupling, is determined by the dimensions of the branch guides. Currently, the branch guide directional coupler 60 is a 3.0 dB coupler having the following dimensions: a=1.22 inches; b=1.955 inches; c=1.620 inches; d=.920 inches; and e=.523 inches. A matching termination or matched load 80 is coupled to the second arm 74 for terminating thereof.

A first arrow 82 and a second arrow 84 shown in FIG. 3 illustrate the flow of power through the branch guide directional coupler 60. The first arrow 82 illustrates the flow of power from the first arm 72 to the fourth arm 78 and into a serpentine applicator 100. The second arrow 84 illustrates the flow of power from the third arm 76 into the second arm 74 and into the matching termination 80.

The branch guide directional coupler 60 is connected to a serpentine applicator 100 as illustrated in both FIGS. 2 and 3. The serpentine applicator 100 receives microwave power from the fourth arm 78 of the coupler 60 through a first microwave guide 102. Power exiting the serpentine applicator 100 enters the third arm 76 of the coupler 60 through a second microwave guide 104. The second microwave guide 104 can include an adjustable phase shifter for fine tuning the microwave circuit.

Figure 5:
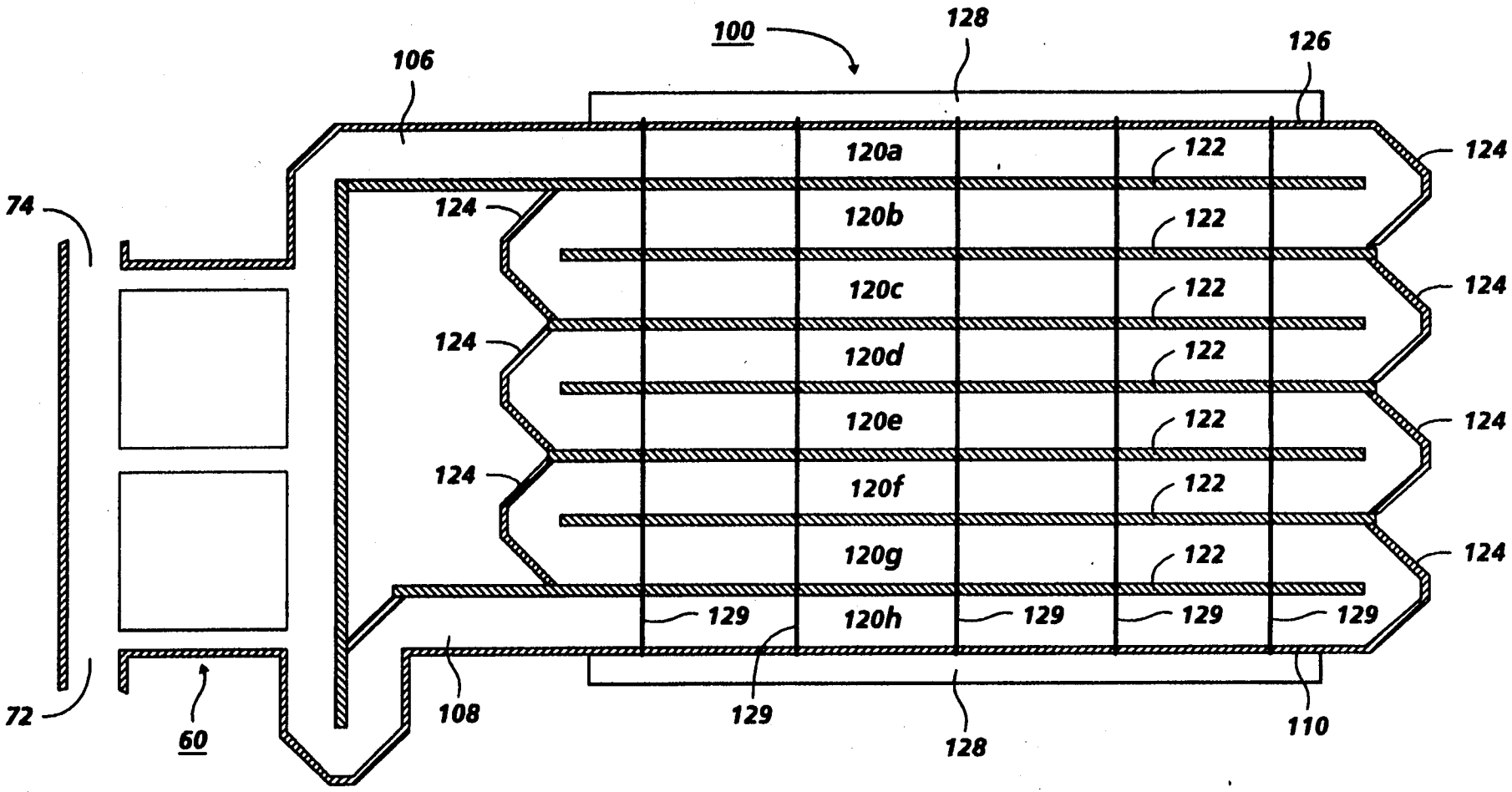
FIG. 5 is a sectional view of a three-branch coupler and an eight-pass serpentine applicator.

Returning to FIGS. 2 and 3, the serpentine applicator 100 has an input 106 connected to the first microwave guide 102 and an output 108 connected to the second microwave guide 104. A sheet of paper 14 passes through the serpentine applicator 100 and exits through a slot 110. The paper 14 enters the applicator on the opposite side but is not show in FIG. 2. As shown in FIG. 5, the serpentine applicator 100 is an eight branch serpentine applicator having generally parallel guide sections or branches **120*a* through 120*h*. Each branch 120 has a height of 2.84 inches and a width of 0.67 inches. As microwave power enters the input 106, the power travels through each branch starting at the first branch 120*a* and ending at the branch 120*h* and to the output 108. The serpentine applicator 100 has a length selected so that the effective electrical length of the traveling wave resonant circuit comprising the serpentine applicator 100 and the directional coupler 60 is equivalent to an integral number of guide wavelengths. With proper adjustment of the length, the microwave circuit becomes a traveling wave circuit resonating at the resonant frequency. In order for the resonant system to function properly, the system resonant frequency and the magnetron frequency must be matched to within a frequency of up to ±5MHz. In addition, the waveguide launcher 42** includes a tuning screw or a phase shifter to permit a one-time optimization of system performance.

FIG. 5 illustrates a sectional plan view of one-half, of the coupler 60 and the serpentine applicator 100. The coupler 60 and the guides 106 and 108 are shown on the same plane as the serpentine applicator 100 for illustration. The interior of the serially interconnected generally parallel guide sections **120*a* through 120*h* joined by U-shaped connecting sections 124 is also shown. Each guide section 120 is connected to the next and partially separated therefrom by a member 122. The connecting sections 124 transmit the microwave power from one guide section to the next guide section with minimum reflections and loss of power. A sheet of paper enters through a slot 126 which is substantially similar to the slot 110 previously described and exits through the slot 110. Paper guide members comprising microwave transparent material such as Teflon TM or polytetraflouroethylene string are attached to the underneath side of the top half of the serpentine applicator 100 from one slot to the other slot to prevent paper from being caught therein when passing from slot 126 to slot 110. In addition, Teflon TM is hydrophobic and consequently does not disturb the ink. Both the slot 126 and the slot 110 are surrounded by a lip member 128 shown in FIGS. 2 and 6. Only one half of the lip is illustrated in FIG. 5. The lip member 128 comprising one-half on the top half and one-half on the bottom half of the serpentine applicator serves as a guide and also as a choke for preventing leakage of microwave power from the serpentine applicator 100. For a more detailed description of the slot 110, the U-shaped connecting section 124, and the lip member 128** refer to co-pending application Attorney Docket Number D/93143 entitled "Apparatus and Method for Drying Ink Deposited by Ink Printing" filed concurrently herewith and herein incorporated by reference.

As microwave power is transmitted from one guide section to the next, the amount of power available for drying in each guide section changes from a relatively large amount of power available in guide section 120*a* to a relatively small amount of power available in guide section 120*h*. For instance, the ratio of electric field strength in the first guide section 120*a* to electric field strength in the last guide section 120*h* is approximately 2 to 1.

Consequently, paper printed with inks having rapid penetration rates may be input to the slot 126 and exit the slot 110 to apply the greatest amount of power to the ink/paper as soon as possible. Paper printed with inks having slow penetrating rates, however, may be input to the slot 110 and exit the slot 126 so that the amount of microwave power applied to the ink/paper increases as the paper travels through the applicator 100. By not applying as much power initially, since the paper passes through guide section 120*h* first, the slower absorbing inks are not heated as rapidly, and so image quality defects, such as mottle and spatter, which can result from slower absorbing inks sitting on the surface of the paper are reduced or prevented altogether. In this way, the final image quality for all types of inks is the same.

Figure 6:
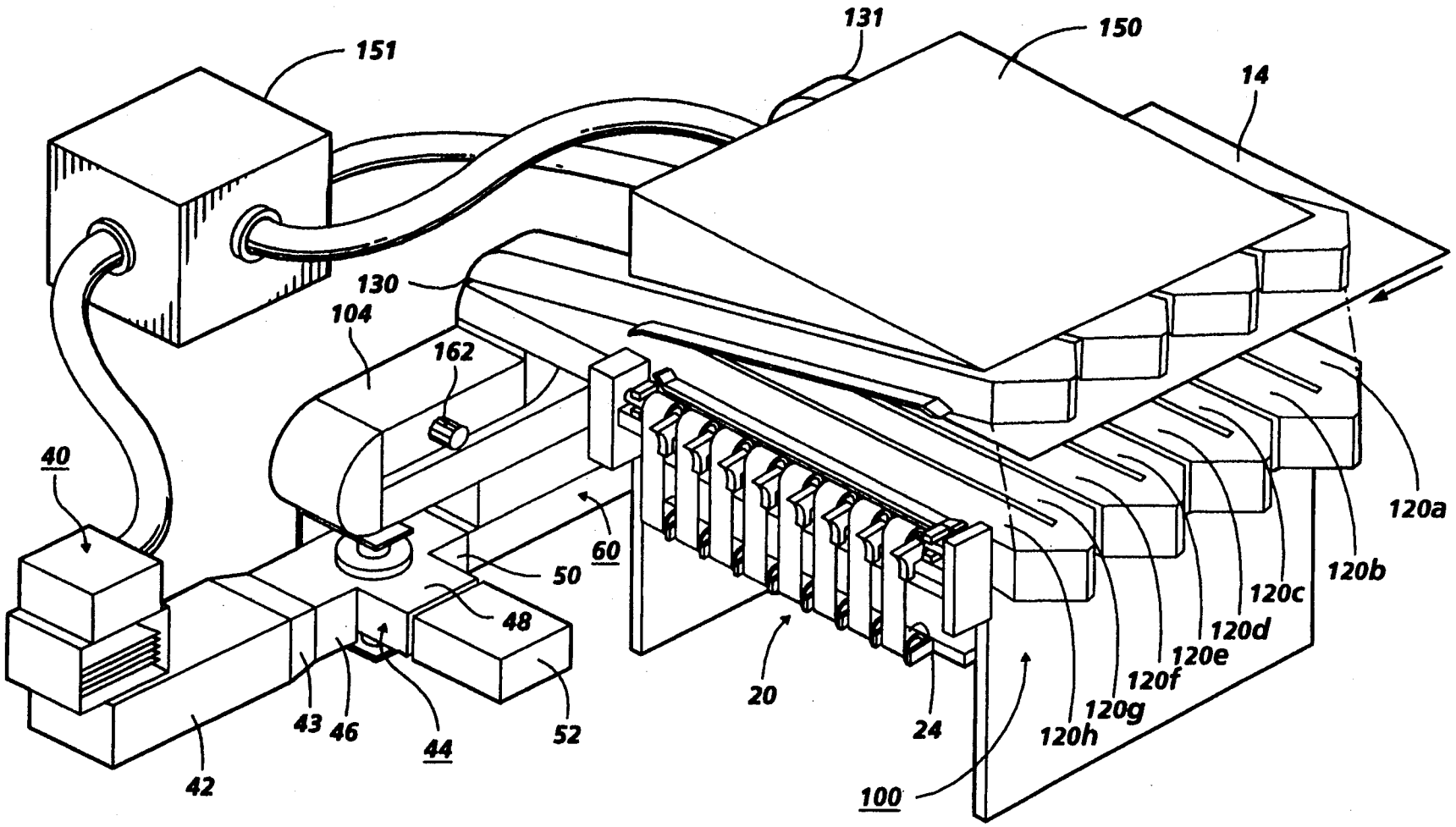
FIG. 6 is a perspective view of a microwave dryer and a manifold of the present invention.
Figure 7:
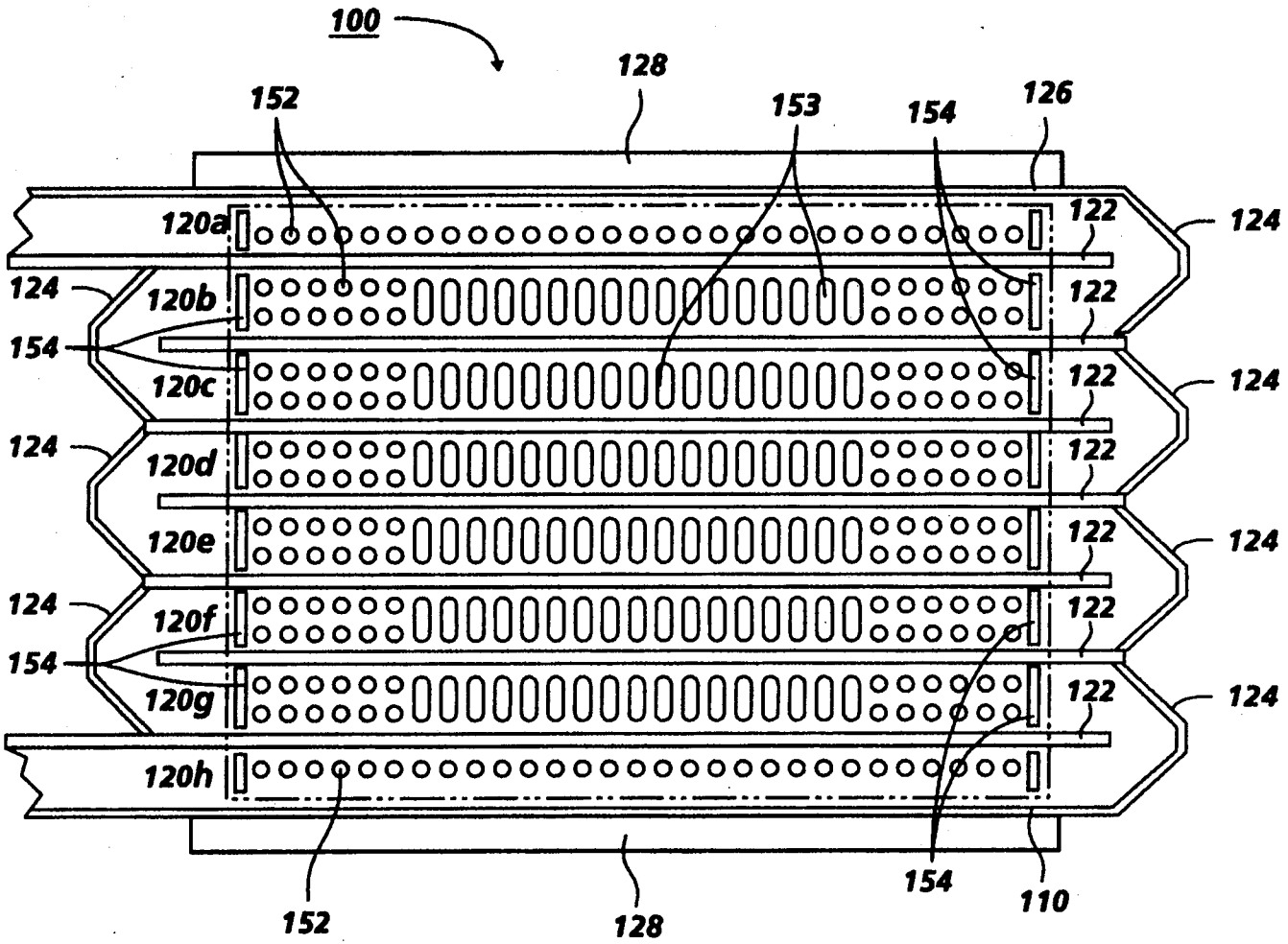
FIG. 7 is a plan view of the serpentine applicator defining holes for the application of convective hot air for drying.

FIG. 6 illustrates the microwave dryer 28 including a manifold 150 which sits atop the serpentine applicator 100. In this embodiment, the applicator 100 is hinged at locations 130 and 131 to provide access to the interior thereof for paper removal if necessary. In the figure, the application 100 and manifold 150 are shown in a raised position. The manifold 150 supplies forced hot air to the top surface of the paper to provide convective hot air drying. Hot air is scavenged from the magnetron 40 and the matching termination 80 and forced by a blower 151 into the manifold 150. The manifold 150 is shaped like a wedge in which the height at the portion receiving forced air from the blower 151 is greater than the height of the distant end thereof. By angling the top surface of the manifold 150, the serpentine applicator may be opened without being obstructed by the manifold due to any frame or machine which may be located above the manifold 150. The hot air passes through a plurality of holes 152 and/or slots 153 defined in the top of the serpentine applicator 100 as illustrated in FIG. 7. FIG. 7 also illustrates the interior of the serpentine applicator located above the side of paper having wet ink. Hot air impinges upon the wet surface of the sheet of paper through the holes 152 and slots 153. A plurality of microwave transparent baffles 154, made of a microwave transparent material such as polystyrene, directs the flow of air to the sheet. Air is removed by means of a vacuum transport which is located below the bottom half of the applicator.

The holes and slots are sized to reduce or prevent microwave leakage from and/or reflections in the waveguides 120. In the present embodiment, the holes are 3mm in diameter and the slots are 3mm wide and 9mm long. Other combinations of holes and slots can be used, but it has been found the slots allow for increased air flow to a sheet of paper for drying.

With a power output of the magnetron 40 of approximately 850 watts, a minimum of approximately 150 watts of thermal power is potentially available from the matched loads and the magnetron due to its inherent inefficiencies. The magnitude of the power available from the matched load depends on the area coverage of ink on the paper. For instance, with low area coverage (20%) approximately 250 watts is dissipated in the termination and for high area coverage (greater than 60%) less than 50 watts is dumped into the matching termination. Thus, energy from the termination 80 is not fixed.

The amount of power dissipated in the matching termination 80 depends on the amount of ink deposited on the sheet 14 and the type of coupler 60. It is possible to design a system in which no power is dissipated in the matching termination 80 if the amount of ink deposited on the paper is a known quantity each time. In such a system, the coupler 60 can be designed to couple the required amount of power to the applicator 100 so that no excess power is absorbed by the termination 80. If the ink covered paper is not a matched load, then microwave power which is absorbed in the termination and converted to thermal power can be recycled for convective drying. Consequently, since ink coverage varies over a wide range, the present invention has a wide latitude in drying all types of printed sheets.

To efficiently couple power with the load in a resonant microwave circuit the resonant microwave system must be tuned at the right electrical length and operate at the optimum resonating frequency. Tuning is accomplished by adjusting the length of the applicator. It is possible to create a properly tuned microwave circuit by merely adjusting the applicator length. However, it is also possible to fine tune the system once the applicator length has been chosen by using a dielectric as a phase shifter. By positioning the dielectric phase shifter, at certain locations in the applicator, fine tuning of the resonant microwave circuit is accomplished. The dielectric phase shifter is moved in and out of the wave guide to tune the system.

Figure 8:
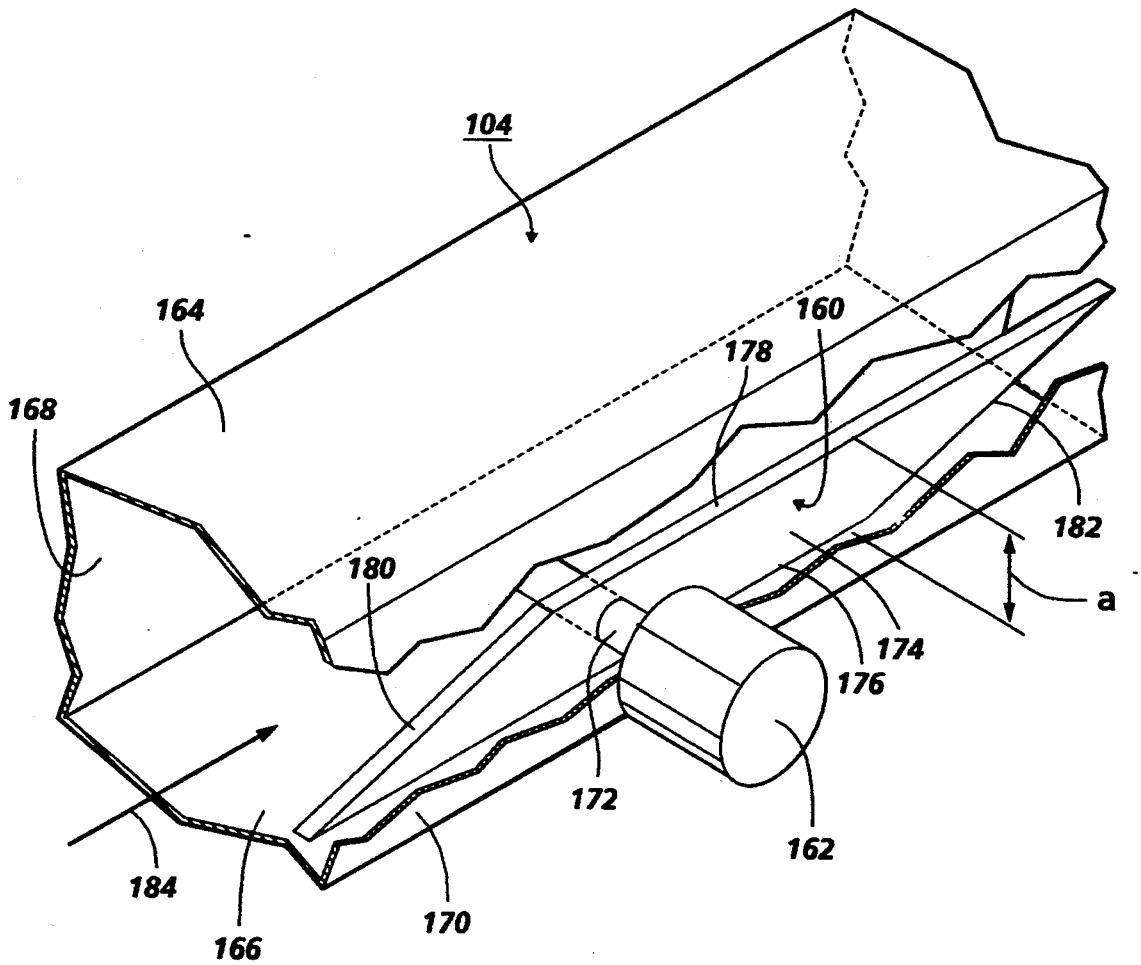
FIG. 8 is a sectional perspective view of a phase shifter within a portion of a waveguide.

FIG. 8 illustrates a dielectric phase shifter 160 and adjusting knob 162 for adjusting the dielectric phase shifter within the second microwave guide 104. The location of the adjusting knob 162 with respect to the second microwave guide 104 is also shown in FIGS. 2, 3 and 6. The dielectric phase shifter 160 is located within the second microwave guide 104 which includes a top wall 164, a bottom wall 166, (also known as the broad walls) and a first side wall 168 and a second side wall 170 (also known as the narrow walls) of the waveguide. The adjusting knob 162 is attached to a adjusting screw 172 which threadingly engages both the first side wall 168 and the second side wall 170 for adjusting the dielectric plate from one side wall to the other side wall. When the dielectric phase shifter 160 is adjacent or next to one of the side walls it has very little effect on the adjustment of the overall length of the microwave circuit. When the dielectric phase shifter 160 is, however, moved toward the center of the waveguide, its effect becomes greater and is maximum when the dielectric phase shifter 160 is at the center of the waveguide.

The dielectric phase shifter 160 comprises a dielectric plate 174 having first and second opposed and substantially parallel surfaces. The dielectric plate 174 is parallelogram shaped and is free of any right angles. The shape of the dielectric plate 174 is defined by four edges, a proximate edge 176 which is located adjacent to the bottom wall 166, a distal edge 178 which is opposed to the proximate edge 176, a leading edge 180 and a trailing edge 182. The leading edge 180 is so named because it is the first edge which receives an application of microwave power, the direction of which is shown by an arrow 184. Each of the edges, the proximate edge 176, the distal edge 178, the leading edge 180 and the trailing edge 182 define the outer bounds of the first and second parallel surfaces of the dielectric plate 174. The distance between the first and second substantially parallel surfaces is approximately one quarter of an inch. The dielectric plate is made of a microwave low loss dielectric material and is currently made of polystyrene. It is also possible, however, to make the dielectric plate of Teflon TM or polytetrafluoroethylene. The adjusting screw 172 is preferably made of a microwave transparent material and is currently made of polystyrene.

The location or position of the dielectric plate within the waveguide produces a phase shift of the phase angle of the microwave power to fine tune the resonating microwave circuit. One aspect of the present invention is to adjust the amount of phase shift with a dielectric plate that requires a minimal amount of space. Consequently, the present phase shifter is relatively short with respect to the guide wave length of the waveguide in use. Another aspect of the present invention is that by positioning the proximate edge 176 adjacent to the interior surface of the bottom wall 166, the bottom wall 166 can be used as an anti-rotation member so that the dielectric plate 174 does not rotate within the waveguide. The proximate edge 176 contacts the interior surface of one of the bottom or top walls thereby preventing rotation of the dielectric plate 174. Consequently, only one positioning knob 162 and one screw 172 are necessary to adjust the dielectric plate within the waveguide. By using the inside surface of the bottom wall 166 as an anti-rotation member, the number of parts necessary to adjust the dielectric plate within the waveguide has been reduced and, consequently, any microwave interactions which occur between the dielectric plate 174 and the adjusting screw 172 are also reduced.

Figure 9:
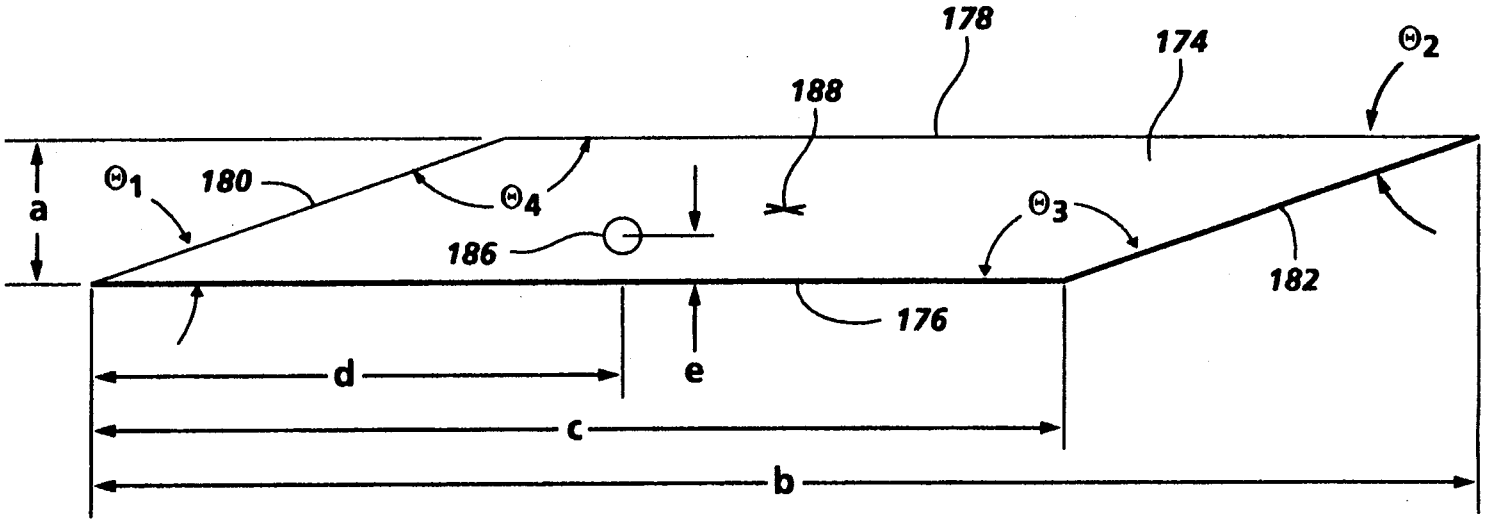
FIG. 9 is an elevational view of a dielectric plate of the phase shifter of the present invention.

FIG. 9 illustrates a plan view of the dielectric plate 174 and the location of an adjusting hole 186 which receives the adjusting screw 172. As can be seen from FIG. 9, the adjusting hole 186 is located below and forward of or off center of a center of axis 188 of the dielectric plate 174. The adjusting hole 186 has been placed off center of the dielectric plate 174 to thereby exert less force on the dielectric plate 174.

As illustrated in FIG. 9, the dielectric plate 174 has a height a which is less than one-half the height of the waveguide or the height of either one of the first side wall 168 or second side wall 170. The overall length of the dielectric plate 174, here shown as dimension b, is less than one guide waveguide in length. Due to size constraints, it was found that existing shapes of known phase shifters could not be scaled in size to meet the size requirements of the present system and still obtain enough latitude in adjusting the overall length of the microwave circuit to obtain a resonating circuit. The dielectric plate 178 provides approximately three-quarters of an inch adjustment in microwave circuit length.

The height "a" of the dielectric plate 174 is approximately 0.75 inches, which is less than 30% of the height of the side walls, while the overall length "b" is approximately 5.89 inches. The length "c" of the proximate edge 176 is 3.38 inches. This is also the length of the distal edge 178. The proximate edge 176 and the leading edge 180 meet at an angle $\Theta_1$ of approximately 17 degrees. Likewise, the trailing edge 182 and the distal edge 178 meet at an angle $\Theta_2$ also approximately 17 degrees. Because the dielectric plate is shaped as a parallelogram, the last remaining angles $\Theta_3$ and $\Theta_4$ are approximately 163 degrees.

Not only is the phase shifter relatively short with respect to the guide wave length of the waveguide it has also been found that if the angles $\Theta_1$ and $\Theta_2$ are much less than 17 degrees, the dielectric plate 174 increased in length. In addition, it was also found that if the angles $\Theta_1$ and $\Theta_2$ became much larger than 17 degrees, such as greater than 25°, the performance of the phase shifter was degraded and caused various reflection problems and interactions of microwaves with the phase shifter itself. Due to cancellation effects and actual interactions it was found that the present length of 5.89 inches achieved the desired result. This is still less than 70 percent of a guide wave length of approximately 9 inches in the present invention.

As previously described, the location of the adjusting hole 186 has been placed forward of and below the center of axis 188. In the present embodiment, the adjusting hole 186 has been placed a distance d of 2.52 inches from the front of the dielectric plate 174 to the center of the adjusting hole 186. The adjusting hole 186 has been placed a distance e of approximately 0.25 inches from the proximate edge 176. Other locations of the adjusting hole 186 are possible, but it has been found that the present location of the adjusting hole 186 not only provides for good anti-rotation of the overall device but also provides for accurate placement of the dielectric plate 174 across the inside bottom surface of the bottom wall 166 of the waveguide portion 104.

Consequently, there has been described a practical and unique phase shifter having a compact shape. It has been found that the described phase shifter having a one-quarter inch teflon dielectric plate or one-eighth inch polystyrene dielectric plate yields a voltage standing wave ratio of 1.1. It has also been found that the phase shifter insertion loss in db is approximately zero for a frequency of 2450 to 2470 range of megahertz. Even at 2430 megahertz the insertion loss is a mere 0.5 db. It has also been found that with virgin paper the power absorbed by the virgin paper can be changed by as much as 200 watts depending on the location of the current phase shifter. The power absorbed by ink on paper can be changed approximately 150 to 250 watts depending on the location of the current phase shifter.

In recapitulation, it is evident that a microwave drying apparatus having the features of the present invention incorporated herein is capable of controlling paper deformation caused by printing with liquid inks. The application of microwave energy to such an ink-laden substrate effectively prevents the formation of cockle and other paper deforming conditions. The microwave dryer of the present invention is fine tuned with a positionable phase shifter for optimizing the resonating traveling wave microwave system.

It is, therefore, apparent that there has been provided in accordance with the present invention, an apparatus for fine tuning a microwave applicator that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A phase shifter for shifting the phase angle of microwaves generated by a microwave generator, the microwaves traveling in a waveguide having a side well of a predetermined height, said phase shift comprising:

a dielectric plate having a parallelogram shape with an included angle being less than 90°, a height of less than one-half the predetermined height of the side wall and a length of less than one guide wavelength long; and a member operatively connected to said plate to position said plate in the waveguide.

2. The phase shifter of claim 1, wherein said length of said dielectric plate is less than 70% of the length of a guide wavelength.

3. The phase shifter of claim 1, wherein said height of said dielectric plate is less than 30% of the height of the side wall.

4. The phase shifter of claim 1, wherein the waveguide further comprises a second side wall, a top wall and a bottom wall, the top wall and the bottom wall intersecting the first mentioned side wall and said second said wall.

5. The phase shifter of claim 4, wherein said dielectric plate further comprises a first and a second substantially parallel surface, a distal edge, a proximate edge, a leading edge and a trailing edge, each of said edges defining the outer bounds of said first and second parallel surfaces, said proximate edge located adjacent to the interior surface of one of the bottom or top walls.

6. The phase shifter of claim 5, wherein said leading edge intersects said proximate edge at an angle of 25° or less.

7. The phase shifter of claim 6, wherein said leading edge intersects said proximate edge at an angle of approximately 17°.

8. The phase shifter of claim 7, wherein said proximate edge contacts the interior surface of one of the bottom or top walls thereby preventing rotation of said dielectric plate.

9. The phase shifter of claim 8, wherein said member is in threaded engagement with one of said side walls.

10. The phase shifter of claim 9, wherein said member comprises a polystyrene screw in threaded engagement with the first mentioned side wall and said second side wall, and extends through said dielectric plate.

11. The phase shifter of claim 10, wherein the distance between said first and second substantially parallel surfaces is no greater than approximately one quarter of an inch.

12. The phase shifter of claim 11, wherein said plate is positioned in the waveguide with the leading edge thereof positioned adjacent to the microwave generator.

13. The phase shifter of claim 12, wherein said member is operatively connected to said plate at a point located between the proximate edge, the leading edge, and the center line of said plate.

14. The phase shifter of claim 13, wherein said dielectric plate is made of polystyrene.

15. The phase shifter of claim 13, wherein said dielectric plate is made of polytetrafluoroethylene.

16. The phase shifter of claim 1, wherein said proximate edge contacts the interior surface of one of the bottom or top walls thereby preventing rotation of said dielectric plate.

17. The phase shifter of claim 16, wherein said member is operatively connected to said plate at a point located between the proximate edge, the leading edge, and the center line of said plate.

* * * * *